US011132866B2

(12) United States Patent
Graboyes et al.

(10) Patent No.: US 11,132,866 B2
(45) Date of Patent: Sep. 28, 2021

(54) PSEUDO SKILL-BASED AND/OR SKILL-BASED VIDEO GAMING SYSTEM INVOLVING A TIME COLLECTION FEATURE AND METHOD OF UTILIZING THE SAME

(71) Applicant: GameCo, LLC, Las Vegas, NV (US)

(72) Inventors: Blaine Goldman Graboyes, Las Vegas, NV (US); Eli Weissman, Brooklyn, NY (US)

(73) Assignee: GAMECO, LLC, Las Vegas, NV (US)

( * ) Notice: Subject to any disclaimer, the term of this patent is extended or adjusted under 35 U.S.C. 154(b) by 0 days.

(21) Appl. No.: 16/367,290

(22) Filed: Mar. 28, 2019

(65) Prior Publication Data

US 2020/0312092 A1 Oct. 1, 2020

(51) Int. Cl.
*G07F 17/32* (2006.01)

(52) U.S. Cl.
CPC ..... *G07F 17/3262* (2013.01); *G07F 17/3211* (2013.01); *G07F 17/3288* (2013.01)

(58) Field of Classification Search
CPC ..... G07F 17/3204; G07F 17/3209; G07F 17/3211; G07F 17/3213; G07F 17/3244; G07F 17/326; G07F 17/3262; G07F 17/3265; G07F 17/3267; G07F 17/3269; G07F 17/3295
See application file for complete search history.

(56) References Cited

U.S. PATENT DOCUMENTS

| | | | | |
|---|---|---|---|---|
| 7,931,530 | B2 | 4/2011 | Anderson et al. | |
| 8,675,660 | B2 | 2/2014 | Arnone et al. | |
| 9,881,451 | B2 | 1/2018 | Arnone | |
| 2002/0132660 | A1 | 9/2002 | Taylor | |
| 2014/0155147 | A1 | 6/2014 | Arnone et al. | |
| 2016/0171835 | A1* | 6/2016 | Washington | G07F 17/3244 463/25 |
| 2017/0124812 | A1 | 5/2017 | Washington et al. | |
| 2017/0287287 | A1* | 10/2017 | Froy | G07F 17/3211 |
| 2019/0114878 | A1* | 4/2019 | Bridges | G07F 17/3295 |

* cited by examiner

*Primary Examiner* — Omkar A Deodhar
(74) *Attorney, Agent, or Firm* — FisherBroyles, LLP; Rob L. Phillips

(57) ABSTRACT

A system and method for operating a casino-style video game with a time collection whereby players make a wager and play a video-based game wherein the player controls the path taken through obstacles, prize symbols and time collection icons. The time collection icons are used to control the overall house advantage. That is, the longer a player plays the game, the more chances to win prizes. Time collection is ideal for controlling payouts in a skill-based or pseudo skill-based video game.

15 Claims, 9 Drawing Sheets

PSEUDO SKILL-BASED AND/OR SKILL-BASED VIDEO GAMING SYSTEM INVOLVING A TIME COLLECTION FEATURE AND METHOD OF UTILIZING THE SAME

FIELD OF THE INVENTION

The embodiments of the present invention relate to a pseudo skill-based or skill-based gaming system having a time collection feature dictating how long a player can play the game.

BACKGROUND

New younger gamblers have different needs than their older counterparts. Younger players are desirous of excitement and interaction whereas older players are satisfied pressing a SPIN or PLAY button. Developers of skill-based and pseudo skill-based games of chance are seeking to attract the younger players (i.e., millennials).

Accordingly, it would be advantageous to develop a pseudo skill-based gaming system having a time collection feature permitting a player to collect time to play the game such that additional awards may be won.

SUMMARY

The embodiments of the present invention are directed to a system and method for operating a casino-style video game with a time collection feature whereby players make a wager and play a video-based game wherein the player controls the path taken through obstacles, prize symbols and time collection icons. The time collection icons are used to control the overall house advantage. That is, the longer a player plays the game, the more chances to win prizes. Time collection is ideal for controlling payouts in a skill-based or pseudo skill-based video game.

One system embodiment of the present invention comprises a gaming machine for playing a timed game comprising: at least a processor running executable instructions related to running a casino game; display; a user interface; ticket reader; bill validator; memory in communication with said processor, said memory storing at least multiple pay tables; and wherein said processor running said executable instructions: receives a wager; causes to be displayed a playing field including a path depicting at least obstacles, prize symbols and time collection icons; receives a player input consistent with maneuvering a player figure along said path during said timed-game; moves said player figure responsive to said player input consistent with maneuvering said player figure; adds time to a game clock responsive to said player figure interacting with said time collection icons along said path; and based on movements of said player figure along said path, renders a payout related to said wager or collects said wager without a payout.

One method embodiment of the present invention comprises utilizing a processor running executable instructions to run a timed-game on a gaming machine including a display, user interface, ticket reader, bill validator, and memory in communication with said at least one processor; and wherein said processor is configured for: accepting a wager; causing to be displayed a playing field including a path depicting at least obstacles, prize symbols and time collection icons; receiving a player input consistent with maneuvering a player figure along said path; moving said player figure responsive to said player input consistent with maneuvering said player figure during said timed-game; adding time to a game clock responsive to said player figure interacting with said time collection icons along said path; and based on said player figures along said path during said timed-game, rendering a payout related to said wager or collects said wager without a payout.

In one embodiment, a plurality of gaming machines may be linked with a central computer to form a network of gaming machines configured as set forth herein. In one embodiment, the gaming machines described herein utilize interfaces in the form of displays having touch screen capability wherein the displays disseminate video content. The gaming machines used to facilitate the embodiments of the present invention may be standalone gaming machines, hand-held gaming devices, bar top gaming machines and the like.

Other variations, embodiments and features of the present invention will become evident from the following detailed description, drawings and claims.

DETAILED DESCRIPTION

Figure 1:
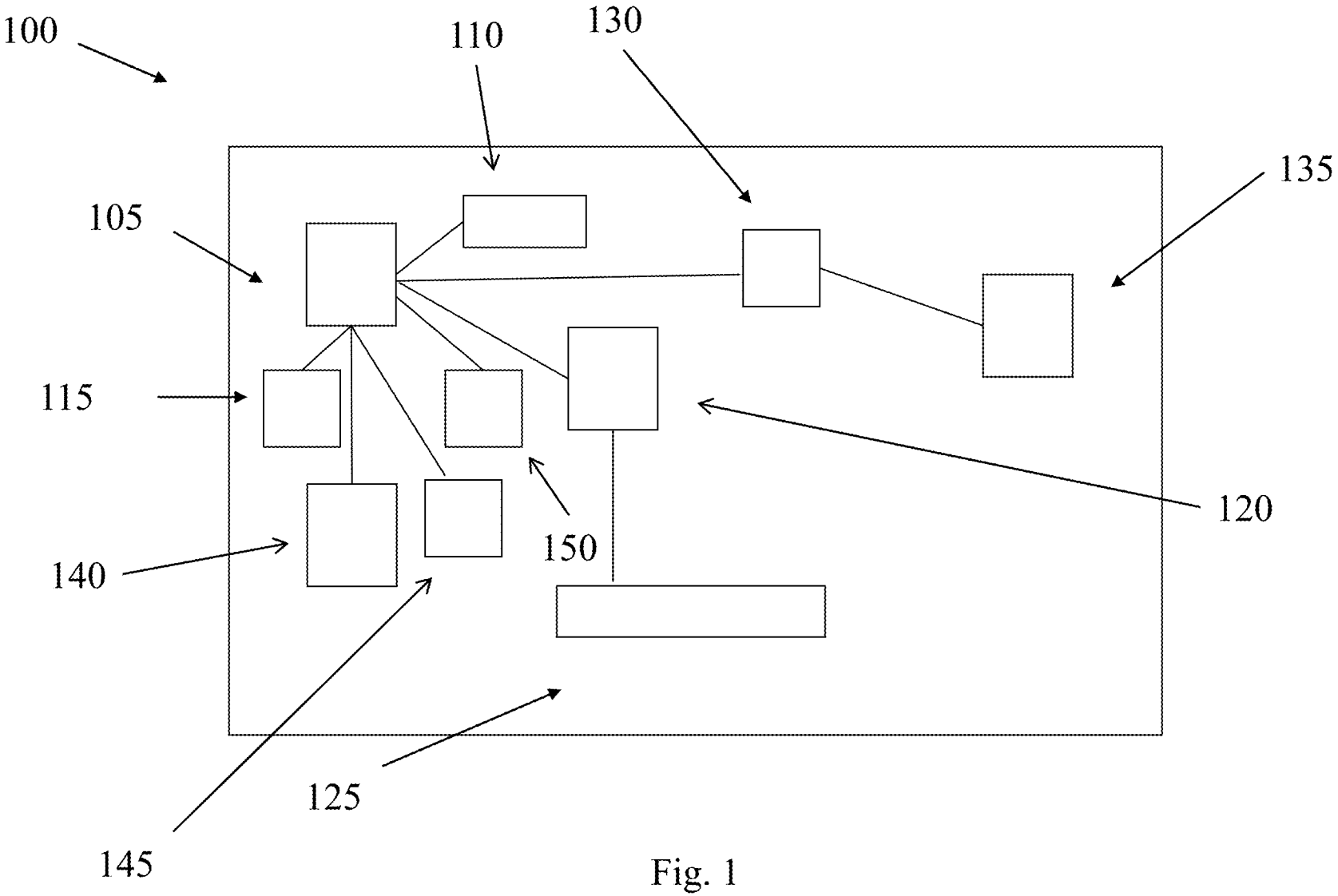
FIG. 1 illustrates a block diagram of components of an electronic gaming machine for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Further-more, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming machine" should be understood to be any one of a general purpose computer, as for example a personal computer, laptop computer, standalone machine, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming machine controlled by the electronic gaming machine's processor as described herein. The processor may be local or remote (i.e., server-based system). The electronic gaming machine may be a standalone device or bar-top device and forming part of a gaming machine network or not. A block diagram of an exemplary electronic gaming machine 100 is shown in FIG. 1. The exemplary electronic gaming machine 100 may include a central processing unit (CPU) also deemed a processor 105 which controls the electronic gaming machine 100 based on instructions stored in program read-only memory (ROM) 110 and pay table ROM 115. Program ROM 110 stores executable instructions related to the operation of the gaming machine 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming machine 100 may be linked to a central game server which allows players to select from a number of games via the electronic gaming machine 100. In such an embodiment, one or more processors integrated into the central server control the gaming machine 100 based on instructions stored in program ROM 110.

A user interface 140 may comprise a button panel or display incorporating touch screen technology or any other devices (e.g., joy stick) providing means for users to communicate with, and instruct, the electronic gaming machine 100. Wager memory 145 stores an amount of money/credits deposited into the electronic gaming machine 100 by a player and specific wager information related to each play of the electronic gaming machine 100. Payout system 150 includes a coupon printer, bill validator and/or similar devices for receiving and distributing currency, tickets and/or coupons via the electronic gaming machine 100.

Those skilled in the art will recognize that the configuration and features of the electronic gaming machine 100 disclosed herein are exemplary and may be altered in any number of ways without impacting the embodiments of the present invention.

Figure 2:
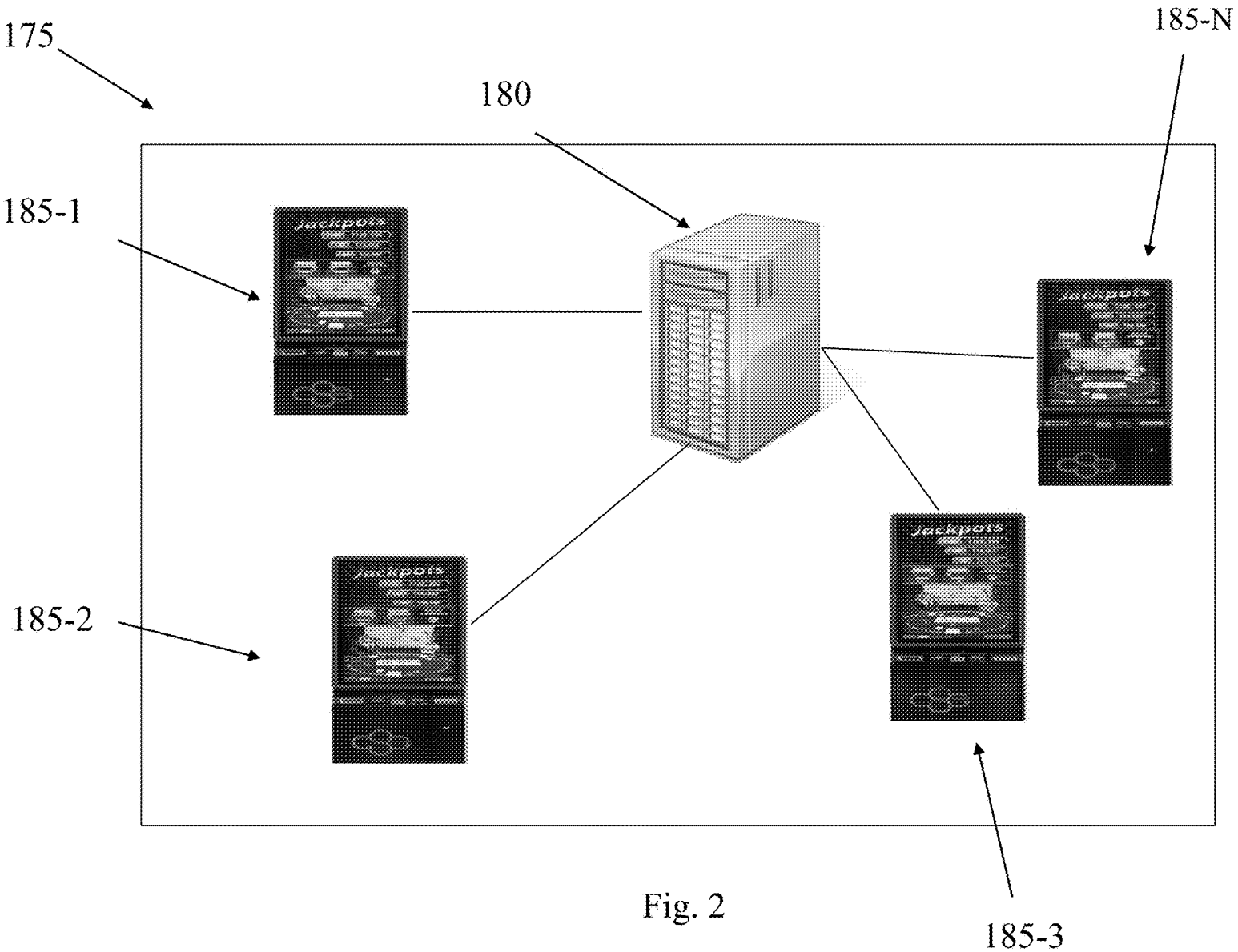
FIG. 2 illustrates a block diagram of a wireless network system accessible by mobile devices for conducting a game according to the embodiments of the present invention.

FIG. 2 shows a block diagram of a gaming network 175 which may be used to facilitate play of a casino-style game of chance via linked gaming machines according to the embodiments of the present invention. The gaming machine network 175 comprises a central processor 180 (e.g., processor-equipped game server) in communication with multiple gaming machines 185-1 through 185-N as described in FIG. 1. The gaming machines 185-1 through 185-N may be smart or dumb clients.

Figure 3:
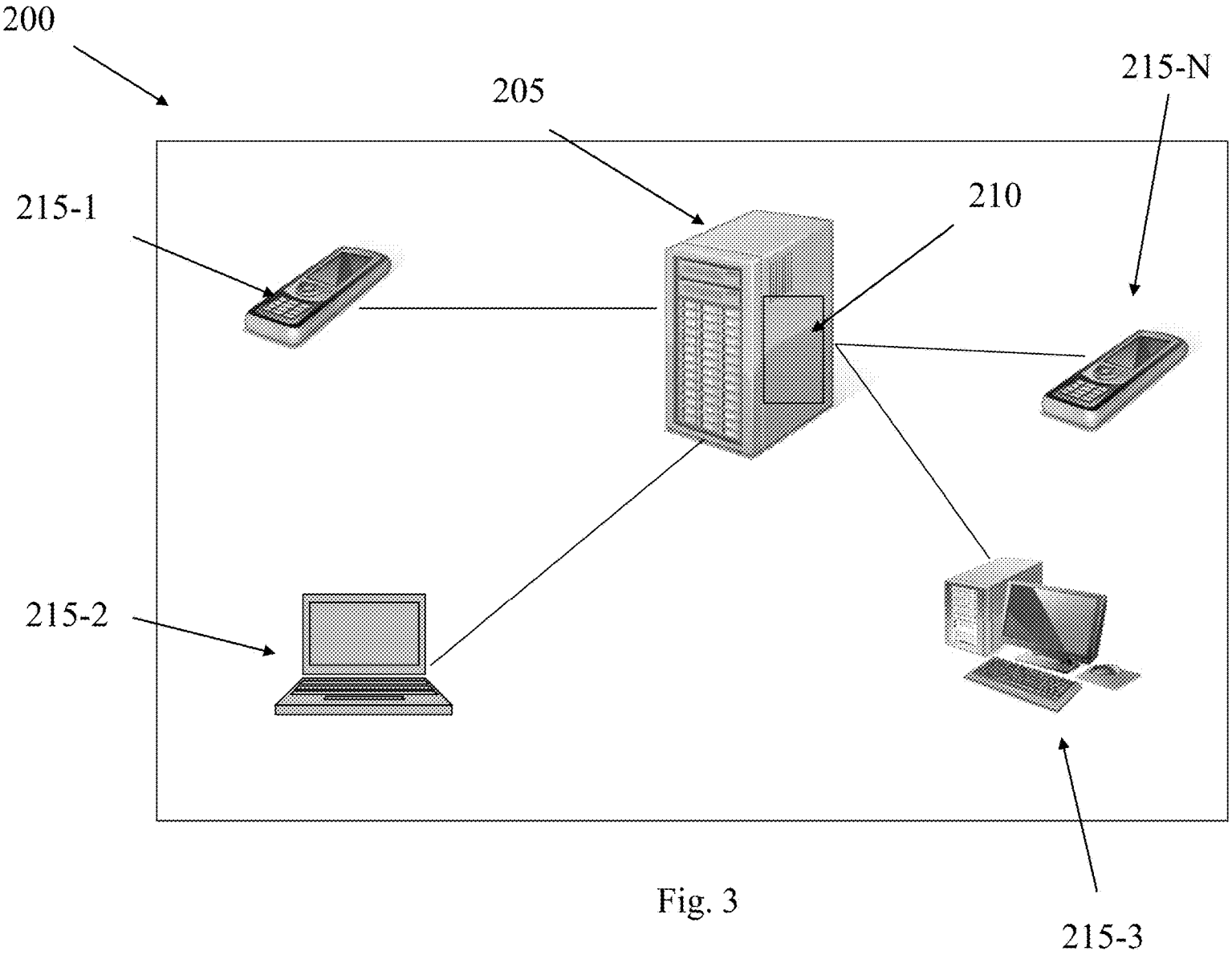
FIG. 3 illustrates a block diagram of a wireless network system accessible by mobile devices for conducting a game according to the embodiments of the present invention.

FIG. 3 shows a block diagram of a wireless gaming system 200 which may be used to facilitate remote play of a casino-style game according to the embodiments of the present invention. The wireless gaming system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video-based game according to the embodiments of the present invention may be in the form of a software application ("App") downloadable onto smart phones, tablets or computers and playable via processing power and a user interface associated therewith.

While the following description focuses on a casino-style video game involving a path through which a player maneuvers a player figure (i.e., some form of player), other games (e.g., race-based games) may utilize the embodiments of the present invention so that players may collect time.

Figure 4A:
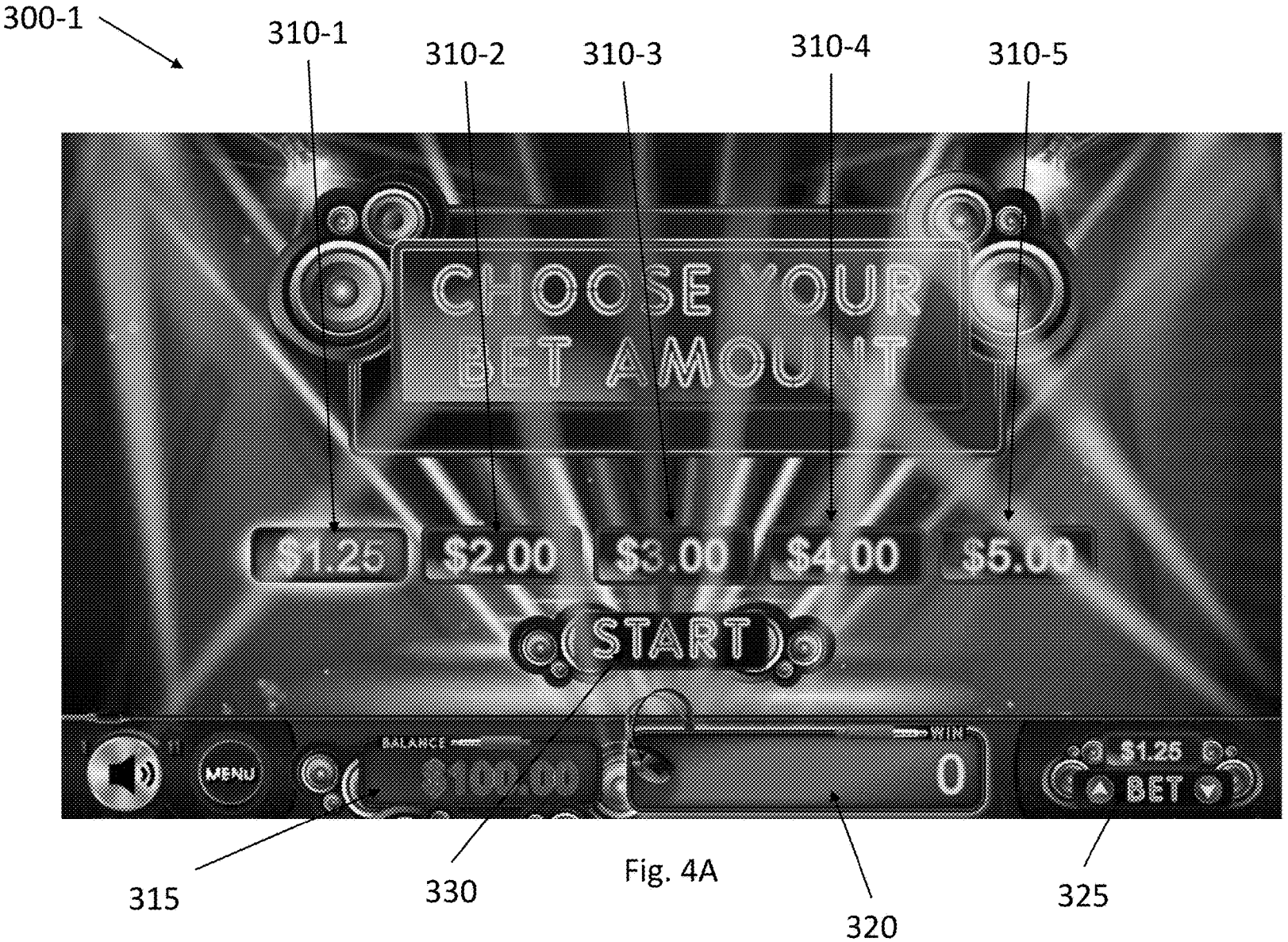
FIGS. 4A through 4D illustrate exemplary screen shots according to the embodiments of the present invention.
Figure 4B:
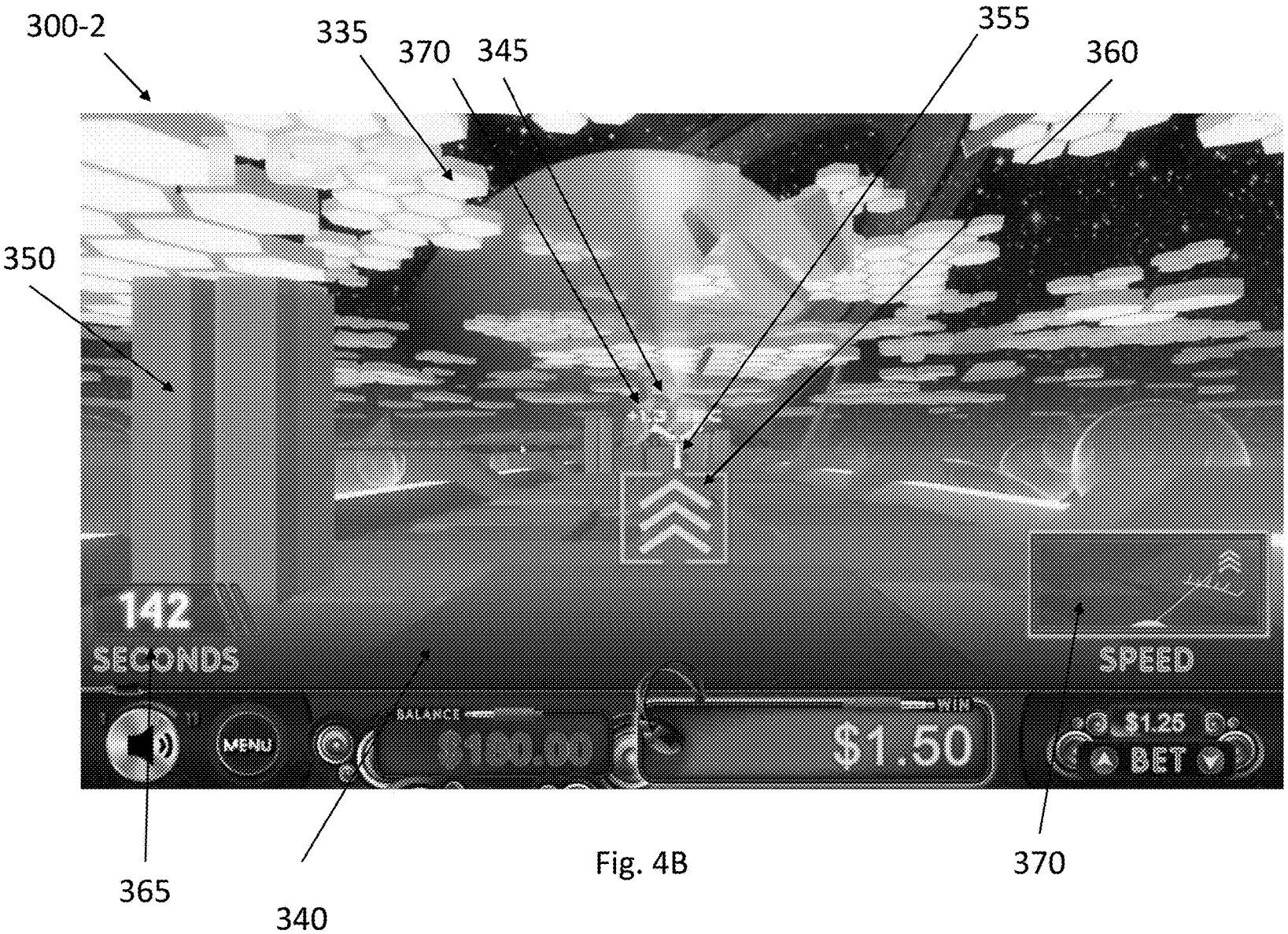
Figure 4C:
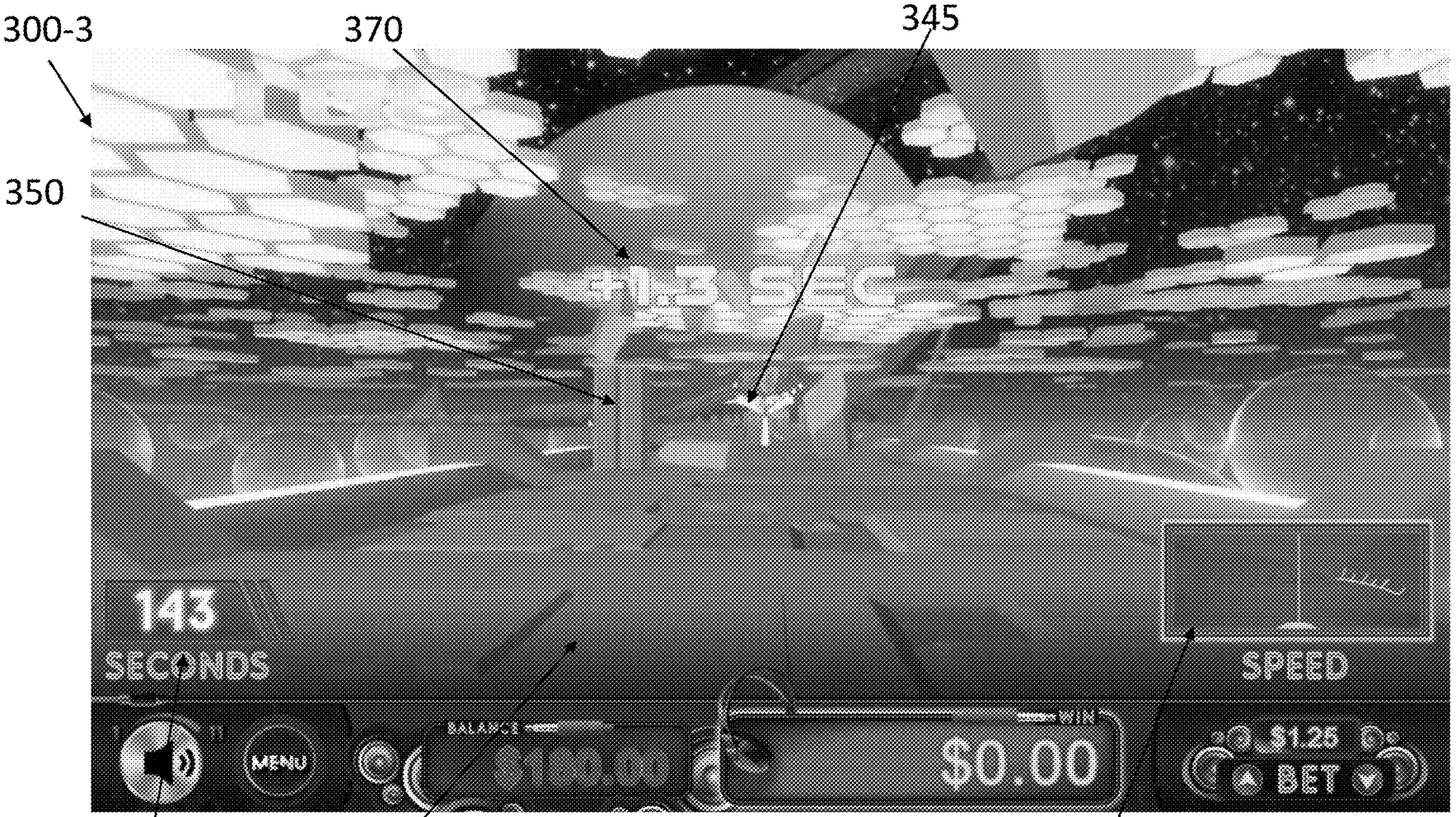
Figure 4D:
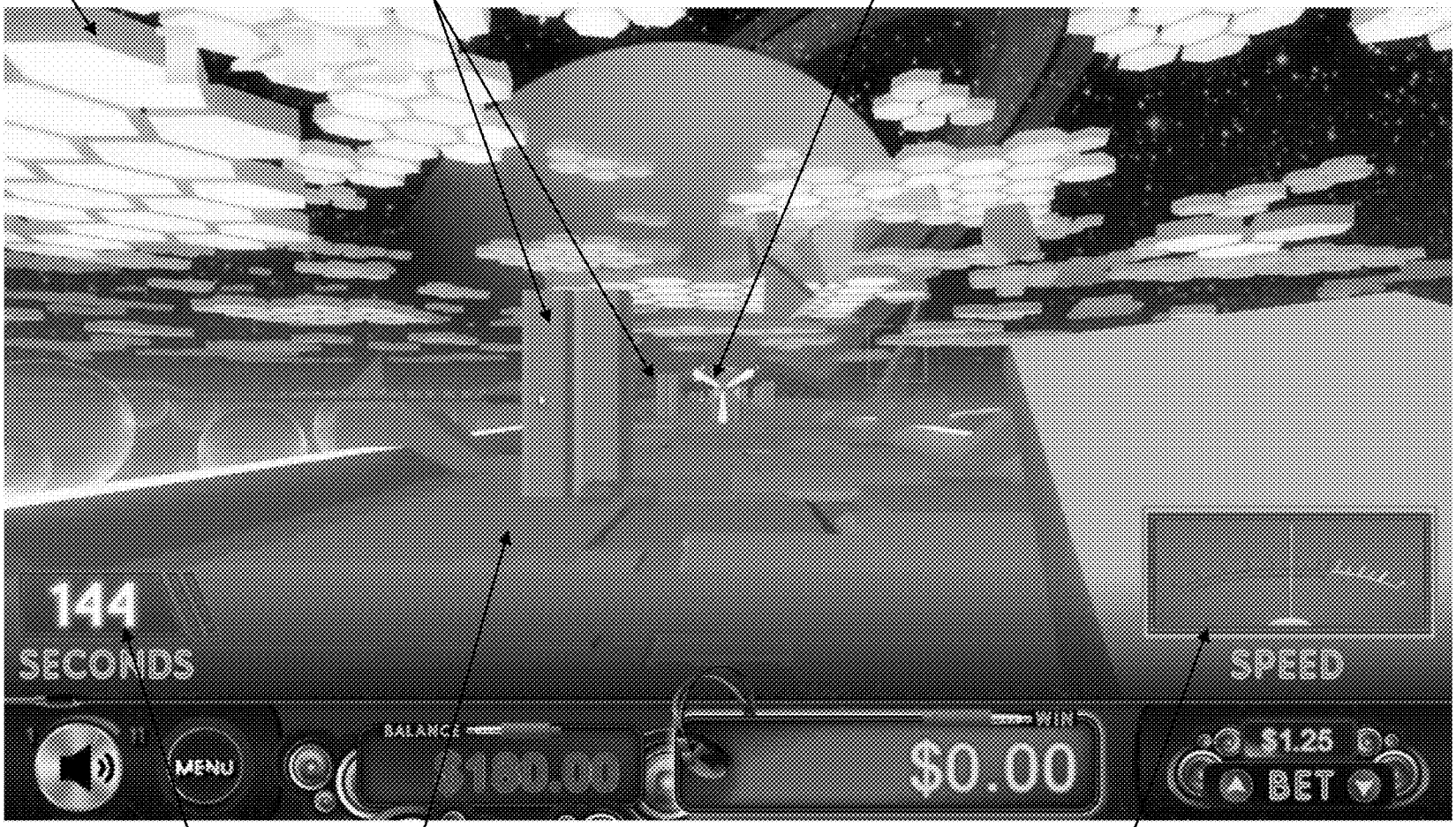

FIG. 4A shows a screen shot 300-1 depicting a home screen 305 where a player selects a bet amount from a plurality of bet amounts 310-1 through 310-N, credit meter 315, win meter 320, bet amount controller 325 and START icon 330. FIG. 4B shows a screen shot 300-2 depicting a playing field or area 335, path 340, player FIG. 345, obstacles 350, time collection icons 355 and direction indicator 360. A clock 365 maintains a game play time. As time collection icons 355 are contacted by the player FIG. 345, time is won. As shown, +1.3 seconds have been won based on the contact. FIGS. 4C and 4D depict screen shots 300-3, 300-4 showing advancement of the player FIG. 345. A speed indicator 370 tracks a speed of the player figure along the path.

A player controls the direction of the player FIG. 345 along the moving path 340 (or moves the player FIG. 345 along a stationary path) via a touch screen, joystick, rollerball, trackball, toggle, buttons and/or other user interface. The speed of the player FIG. 345 may be controlled by the player via a foot pedal, or the speed may be randomly controlled by the processor or may be specifically controlled by the processor given the movement of the path 340. Controlling the speed of the path 340 and/or player FIG. 345, like controlling the time collection, permits the payouts and house advantage to be maintained in suitable ranges.

In one embodiment, the game is pseudo skill-based meaning that the processor is configured to utilize the time collection icons 355, speed of the path 340, obstacles 350 and/or prize icons in a manner to ensure the house has an edge no matter how skilled the players might be. Of course, players are able to win during individual game sessions, but players over meaningful periods of time will collectively lose to the house as is the case with all casino games. In other words, the theoretical math of the pseudo skill-based game favors the house. For example, to lessen the ability to win prizes, the processor may speed up the path 340, add obstacles 350, and/or limit or hide time collection icons 355 (as well as the amount of time won) and prize icons making it more challenging for players to collect more time, avoid obstacles and/or interact with prize icons. On the other hand, to increase the ability to win prizes, the processor may slow down the path 340, remove obstacles 350 and/or expose time collection icons 355 (as well as the amount of time won) and prize icons making it less challenging for players to collect more time, avoid obstacles and/or interact with prize icons. Consequently, the processor is configured to manipulate the game to drive payouts in a preferred manner. In one embodiment, the payouts may be dictated by a random number generator after which the processor configures the game to provide such a randomly determined payout by controlling the path 340, obstacles 350, time collection icons 355 and/or prize icons. Interacting with (i.e., not avoiding) obstacles 350 may reduce winnings or collected time.

In one embodiment of the present invention, a game termination feature may also be used by the processor to terminate the game at the desired moment the specific pre-established prize has been won. For example, a game-ending obstacle may be dropped into the path 340 such that the player may not avoid the same. A countless number of such game termination features may be incorporated into the game as a means of controlling outcomes. The time collection icons 355 may also include negative time (i.e., time of play decreased).

Figure 5:
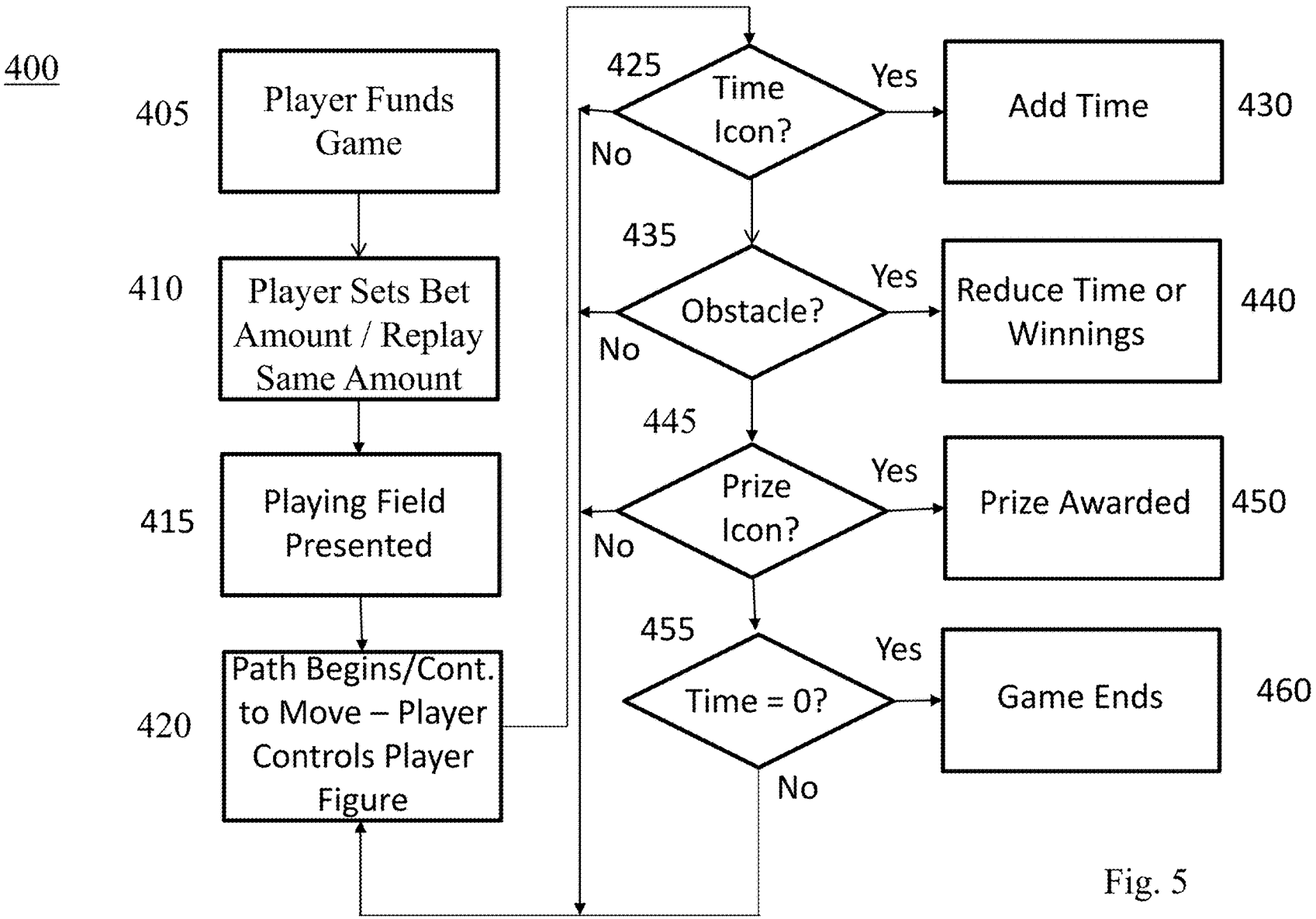
FIG. 5 illustrates a flow chart detailing one methodology for conducting a casino-style game according to the embodiments of the present invention.

FIG. 5 shows a flow chart 400 detailing one methodology for conducting a casino-style game according to the embodiments of the present invention. At 405, a player funds the gaming machine with currency, coupons or tickets. At 410, the player selects a bet amount. At 415, a playing field is presented on a gaming machine display. At 420, the game path begins to move requiring the player to control the player figure via a user interface. At 425, 435 and 445, it is determined if the player FIG. 345 has interacted with any time collection icons 355, obstacles 350 or prize icons, respectively. These interactions are being monitored collectively in real time as the game is played. If interactions occur, at 430, 440 and 450 time is awarded, time of play or prize amounts reduced, and prizes awarded, respectively. At 455, it is determined if game time has reached zero. If time has reached zero, at 460, the game ends. If time has not reached zero, the chart 400 loops back to 420 and play continues.

Figure 6:
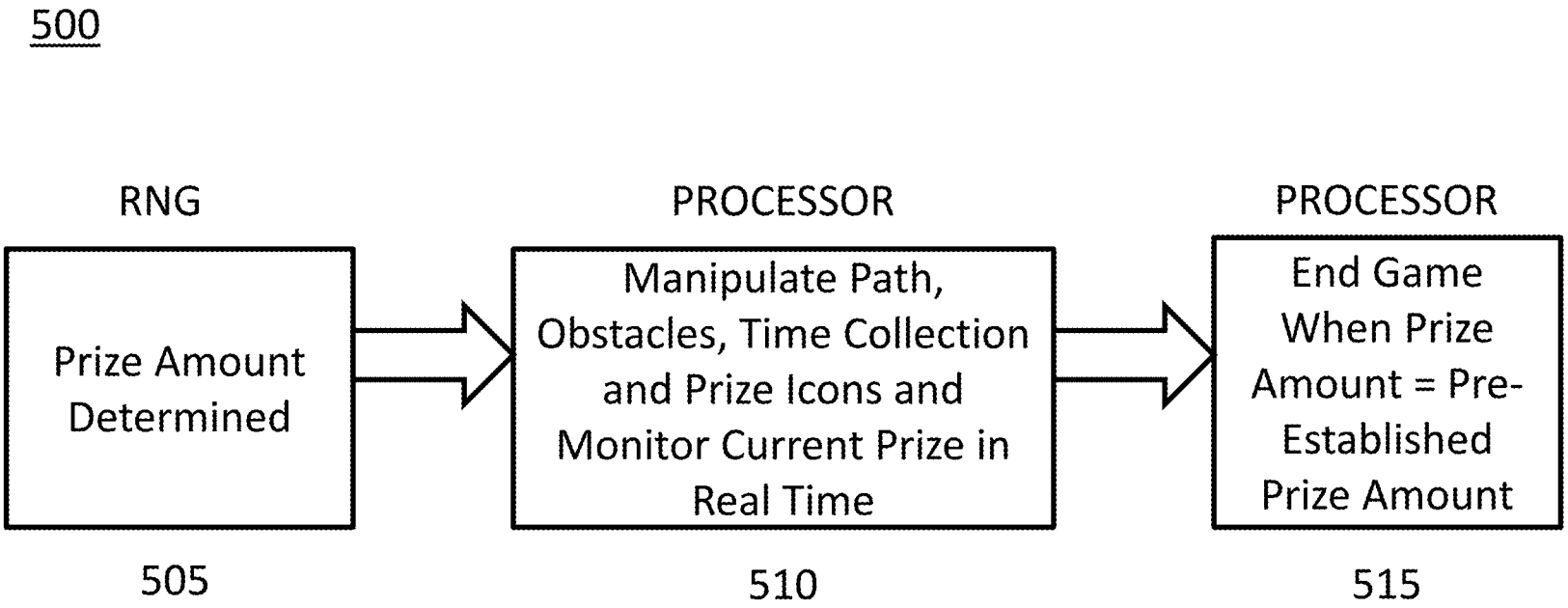
FIG. 6 illustrates a block diagram detailing one methodology for conducting a casino-style game according to the embodiments of the present invention.

FIG. 6 shows a block diagram 500 detailing one methodology for conducting a casino-style game according to the embodiments of the present invention. At 505, a random number generator pre-determines a prize amount based on the wager amount. At 510, the processor manipulates the path, obstacles, time collection and prize icons and monitors a current prize level in real time. At 515, the processor ends the game when the actual prize amount equals the pre-established prize amount.

While endless runner type game is detailed herein, many types of games are suitable for the embodiments of the present invention including racing games, shooting games, flying games and the like. That is, the embodiments of the present invention are suitable for any timed gamed. In a shooting game, for example, the player may shoot time collection icons to obtain additional time to play and win prizes.

Although the invention has been described in detail with reference to several embodiments, additional variations and modifications exist within the scope and spirit of the invention as described and defined in the following claims.

We claim:

1. A gaming machine for playing a timed game comprising:

at least a processor running executable instructions related to playing a casino game;

a display;

a user interface;

a ticket reader;

a bill validator;

memory in communication with said processor, said memory storing at least multiple pay tables; and wherein said processor:

manages a received wager;

causes to be displayed on said display a virtual game playing area depicting at least virtual time collection icons;

receives player inputs consistent with controlling movements of one or more virtual game elements related to said timed game being played within said virtual game playing area;

responsive to said player inputs, controls said one or more displayed virtual game elements consistent with said player inputs;

adds time to a timed game clock responsive to said player inputs resulting in interaction between said virtual game elements and said virtual time collection icons depicted on said display;

manipulates said game playing area based on a skill-level of a player playing said timed game whereby an ability to cause interactions between said virtual game elements and said virtual time collection icons depicted on said display is made more challenging with an increase in said skill level of said player;

based on said player inputs during said timed game, renders a payout related to said wager or collects said wager without a payout; and utilizes a game termination feature to manage house advantage.

2. The gaming machine for playing a timed game of claim 1 wherein said game clock is depicted on said display.

3. The gaming machine for playing a timed game of claim 1 wherein said game is a shooting game, racing game, flying game or running game.

4. The gaming machine for playing a timed game of claim 1 further comprising wherein said processor running said executable instructions: causes to be displayed virtual time collection icons in a manner to result in a pre-determined timed game outcome.

5. A gaming machine for playing a timed game comprising:

at least a processor running executable instructions related to playing a casino game;

display;

a user interface;

ticket reader;

bill validator;

memory in communication with said processor, said memory storing at least multiple pay tables; and wherein said processor:

manages a received wager;

causes to be displayed a virtual playing field including a virtual path depicting at least virtual obstacles, virtual prize symbols and virtual time collection icons;

receives a player input consistent with maneuvering a virtual player figure along said virtual path;

responsive to said player input, moves said player figure consistent with said player input;

adds time to a game clock responsive to said virtual player figure interacting with said virtual time collection icons along said virtual path during said timed game;

manipulates said virtual playing field based on a skill-level of a player playing said timed game whereby an ability to cause interactions between said virtual player figure and said virtual time collection icons depicted on said display is made more challenging with an increase in said skill level of said player;

based on said virtual player figure movements along said virtual path during said timed game, renders a payout related to said wager or collects said wager without a payout; and utilizes a game termination feature to manage house advantage.

6. The gaming machine for playing a timed game of claim 5 wherein said game clock is depicted on said display.

7. The gaming machine for playing a timed game of claim 5 wherein said processor running said executable instructions: causes time and/or prize amounts to be reduced responsive to said virtual player figure interacting with said virtual obstacles.

8. The gaming machine for playing a timed game of claim 5 wherein said processor running said executable instructions: causes prize amounts to be increased responsive to said virtual player figure interacting with said prize symbols.

9. The gaming machine for playing a timed game of claim 5 further comprising wherein said processor running said executable instructions: causes to be displayed virtual time collection icons in a manner to result in a pre-determined timed game outcome.

10. A method for playing a timed game comprising:

utilizing a processor running executable instructions to run a casino game on a gaming machine including a display, user interface, ticket reader, bill validator, and memory in communication with said at least one processor; and wherein said processor is configured for:

managing a received wager;

causing to be displayed a virtual game playing area depicting at least virtual time collection icons;

receiving a player input consistent with virtual in game actions related to said timed game being played within said virtual game playing area;

responsive to said player input, controlling virtual in game elements consistent with said player inputs;

adding time to a game clock responsive to said virtual in game elements interacting with said virtual time collection icons;

manipulating said virtual game playing area based on a skill-level of a player playing said timed game whereby an ability to cause interactions between said virtual in game elements and said virtual time collection icons depicted on said display is made more challenging with an increase in said skill level of said player;

based on said player actions during said timed game, rendering a payout related to said wager or collecting said wager without a payout; and utilizing a game termination feature to manage house advantage.

11. The method of for playing a timed game of claim 10 wherein said processor is further configured for: causing to be displayed in said virtual game playing area virtual obstacles and virtual prize symbols.

12. The method of for playing a timed game of claim 10 wherein said processor is further configured for: causing to be displayed a game clock.

13. The method of for playing a timed game of claim 10 wherein said processor is further configured for: causing time and/or prize amounts to be reduced responsive to said player interactions with said virtual obstacles.

14. The method of for playing a timed game of claim 10 wherein said processor is further configured for: causing prize amounts to be increased responsive to said player interactions with said virtual prize symbols.

15. The method of for playing a timed game of claim 10 wherein said processor is further configured for: causing to be displayed virtual time collection icons in a manner to result in a pre-determined game outcome.

* * * * *